US006332610B1

(12) United States Patent
Hiura

(10) Patent No.: US 6,332,610 B1
(45) Date of Patent: Dec. 25, 2001

(54) SHEET CONTAINING APPARATUS

(75) Inventor: Hiroshi Hiura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/614,379

(22) Filed: Jul. 11, 2000

(30) Foreign Application Priority Data

Jul. 12, 1999 (JP) ..... 11-198172

(51) Int. Cl.[7] ..... B65H 1/00
(52) U.S. Cl. ..... 271/171; 271/162
(58) Field of Search ..... 271/171, 162, 271/18

(56) References Cited

U.S. PATENT DOCUMENTS 5,215,303 * 6/1993 Yamada et al. ..... 271/171 X
5,433,427 * 7/1995 Ishikawa et al. ..... 271/171 X
6,116,591 * 9/2000 Kim ..... 271/171

* cited by examiner

*Primary Examiner*—David H. Bollinger
(74) *Attorney, Agent, or Firm*—Fitzpatrick, Cella, Haper & Scinto

(57) ABSTRACT

The present invention provides a sheet containing apparatus which is mounted to an image forming apparatus and adapted to contain a sheet to be fed to image forming mechanism of the image forming apparatus. And the sheet containing apparatus has a frame having a bottom plate and a side plate upright from the bottom plate, an end regulating mechanism movable in accordance with a size of a sheet contained in the frame and adapted to regulate an end of the sheet, and a flexion preventing mechanism provided on the end regulating mechanism and adapted to prevent the end regulating mechanism from being flexed by engagement with the side plate.

19 Claims, 15 Drawing Sheets

SHEET CONTAINING APPARATUS

BACKGROUND OF THE INVENTION

1. Field of the Invention

The present invention relates to a sheet containing apparatus and an image forming apparatus having such a sheet containing apparatus.

2. Related Background Art

In the past, in image forming apparatuses such as copying machines, printers and facsimiles, a sheet feeding apparatus for feeding a sheet to an image forming portion was provided and a sheet containing apparatus for containing sheets to be fed was provided in the sheet feeding apparatus.

As an example of such a sheet containing apparatus, there is a sheet feeding cassette detachably attached to an image forming apparatus. Among such cassette, there is a cassette of so-called separation claw type having a separation claw as a separation system for separating and feeding out sheets one by one. Since the separation claw system can separate and feed out the sheets one by one with a relatively cheap arrangement, it is widely used in the sheet feeding cassette.

Further, as one of such sheet feeding cassettes, a universal cassette capable of containing sheets having various different sizes is known. In such a universal cassette, a side regulating plate and a trailing end regulating plate which can be shifted to positions corresponding to various sheet sizes are provided within a body of the sheet feeding cassette, so that sheets having various sizes can be contained in the cassette by changing the positions of the side regulating plate and the trailing end regulating plate.

Incidentally, particularly when the sheet feeding cassette is compact or thin, the side regulating plate is often formed from resin such as ABS or a thin sheet metal. In this case, an abutment face for regulating a lateral edge of the sheet is a reference face for lateral edges of the sheets to be contained and has an important role for regulating skew feeding and lateral registration of the sheet.

FIG. 11 is a top plan view of a conventional universal cassette, FIG. 12 is a sectional view taken along the line XII—XII, and FIG. 13 is a sectional view taken along the line XIII—XIII.

In FIGS. 11 and 13, a universal cassette (referred to as "sheet feeding cassette" hereinafter) 1 includes an intermediate plate 2 rotatable around a shaft 3 secured to the sheet feeding cassette 1, an intermediate plate spring 13 for lifting the intermediate plate 2, a sheet feeding roller 21 rotatable in a direction shown by the arrow, sheets S such as transferring materials, and a trailing end regulating plate 7 for regulating trailing ends of the sheets.

Further, the sheet feeding cassette 1 is provided with a pair of side regulating plates 5, 6 movable in a width-wise direction of the sheet S and adapted to regulate left and right lateral edges of the sheets S, and the side regulating plates 5, 6 has racks 5*a*, 6*a*, respectively, and a pinion gear 8 is engaged by central portions of the racks 5*a*, 6*a*.

By the provision of such a rack mechanism, the front side regulating plate (referred to as "first side regulating plate" hereinafter) 5 and the rear side regulating plate (referred to as "second side regulating plate" hereinafter) 6 in a mounting direction of the sheet feeding cassette 1 can be slid in a direction shown by the arrow $D_{11}$ in synchronous with each other so that both lateral edges of the sheets S can be regulated simultaneously with respect the center as a conveyance reference of sheet. Incidentally, FIGS. 11 and 13 show a condition that sheets S having minimum size are contained in the sheet feeding cassette 1.

After both lateral edges of the sheets S having minimum size contained in the sheet feeding cassette 1 are regulated, as shown in FIG. 14, a fixing member 14 of the first side regulating plate 5 is rotated to a position shown by the broken line.

By rotating the fixing member 14 in this way, a rib leading end 14*a* of the fixing member 14 is inserted into a fixing groove la corresponding to the minimum size sheet S among a plurality of fixing grooves provided in the sheet feeding cassette 1 in correspondence to various sheet sizes, with the result that the side regulating plates 5, 6 are fixed.

Incidentally, in FIG. 14, a pair of conveying rollers 23 serve to conveying the sheet S fed out by the sheet feeding roller 21.

The side regulating plates 5, 6 have separation claws 11, 12, respectively. Similar to a well-known separation claw system, the separation claws 11, 12 catch both front corners of the sheet S, and overlapping widths between the separation claws 11, 12 and the sheet S are normally set to be constant regardless of the sheet size.

In the sheet feeding apparatus having the above-mentioned arrangement, when a sheet feeding signal is received from a main body of the image forming apparatus, for example as shown in FIG. 13, the semi-circular sheet feeding roller 21 is rotated in the direction shown by the arrow. As a result, when the roller is urged against the uppermost sheet S, the sheets S are fed and then are caught by the separation claws 11, 12.

Incidentally, the sheets S caught by the separation claws 11, 12 are further fed by the sheet feeding roller 21 in a condition that the leading ends of the sheets are regulated, with the result that loops are formed in the sheets between the sheet feeding roller 21 and the separation claws 11, 12.

As the loops grow, a repulsion force is also increased. Consequently, sheets other than the uppermost sheet forcibly looped by the sheet feeding roller 21 cannot maintain their loops due to their own repelling forces, with the result that these sheets are separated from the uppermost sheet. On the other hand, since the separation claws 11, 12 regulate only the front corners of the sheets, when the repulsion force of the looped uppermost sheet exceeds the regulating force of the separation claws 11, 12, the front corners of the uppermost sheet rides over the separation claws 11, 12, and the separated uppermost sheet is conveyed by the pair of conveying rollers 23.

However, in the sheet feeding apparatus having such a sheet feeding cassette, when the mounting direction of the sheet feeding cassette is perpendicular to a sheet feeding direction, if the sheet feeding cassette is mounted with a strong force, the sheet stack is struck against the rear side or second side regulating plate 6 due to inertia. As mentioned above, since the second side regulating plate 6 is formed from resin such as ABS or thin sheet metal, if the sheet stack strikes against the second side regulating plate, as shown in FIG. 15, an upper part of the second side regulating plate will be flexed temporarily in the mounting direction.

If the upper part of the second side regulating plate is flexed in this way, as shown in FIG. 15, when it is assumed that a flexed amount of the second side regulating plate 6 is L1 and a width of the sheet S caught by the front side separation claw 11 is L, in dependence upon the force for mounting the sheet feeding cassette 1, L1>L may be established, with the result that the sheet S is disengaged from the rear side separation claw 12, or, from the front side separation claw 11 if the sheet S is deviated toward the rear side due to the shock.

If the sheet S is disengaged from the separation claws 11, 12, when the sheet feeding cassette 1 is mounted or dismounted with respect to the main body of the image forming apparatus in such a condition, the sheet S is pinched between the cassette and the main body of the image forming apparatus, thereby damaging the sheet. Further, in the sheet feeding operation, since the sheet S is fed out in a condition that one front corner of the sheet S is not caught by the separation claw 11 or 12, sheet may be skew-fed and accordingly poor sheet feeding may occur.

SUMMARY OF THE INVENTION

The present invention is made in consideration of the above-mentioned circumstances, and an object of the present invention is to provide a sheet feeding apparatus and an image forming apparatus having such a sheet feeding apparatus, which can prevent damage of a sheet, and skew-feeding of a sheet and poor sheet feeding.

To achieve the above object, according to the present invention, there is provided a sheet containing apparatus mounted to an image forming apparatus and adapted to contain a sheet to be supplied to image forming means of the image forming apparatus, comprising a frame having a bottom plate and a side plate upright from the bottom plate, end regulating means movable in accordance with a size of a sheet contained in the frame and adapted to regulate an end of the sheet, and flexion preventing means provided on the end regulating means and adapted to prevent the end regulating means from being flexed by engagement with the side plate.

DESCRIPTION OF THE PREFERRED EMBODIMENTS

The present invention will now be fully explained in connection with embodiments thereof with reference to the accompanying drawings.

Figure 1:
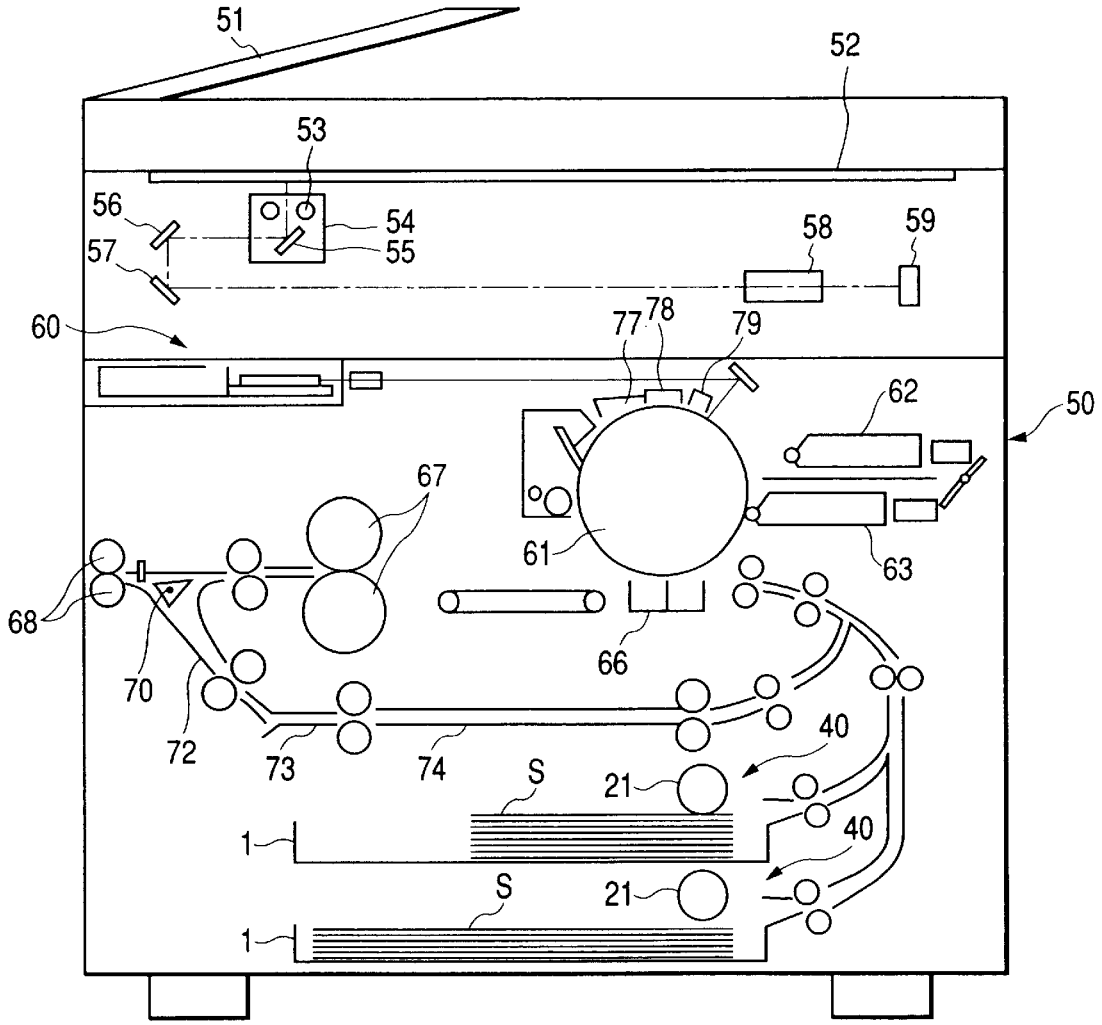
FIG. 1 is a view showing an entire construction of an image forming apparatus having a sheet feeding apparatus according to a first embodiment of the present invention.

FIG. 1 is a view showing an entire construction of an image forming apparatus having a sheet feeding apparatus according to a first embodiment of the present invention. In FIG. 1, an original feeding apparatus 51 is rested on a main body of an image forming apparatus 50.

Originals (not shown) stacked on the original feeding apparatus are successively conveyed one by one onto an original platen glass 52 of the main body of the image forming apparatus 50 by means of the original feeding apparatus 51. When the original is conveyed in this way, a scanner unit 54 is shifted to illuminate the original while lighting a lamp 53.

Thereafter, light reflected from the original passes through a lens 58 through mirrors 55, 56, 57 and then is inputted to an image sensor portion 59. An image signal inputted to the image sensor portion 59 is directly read out or is temporarily stored in an image memory (not shown) and then is read out. Thereafter, the signal is inputted to an exposure control portion 60 through a pixel modulating portion (not shown).

Further, in FIG. 1, a surface of a photosensitive drum 61 as an image bearing member previously charged with predetermined potential by a primary charger 78 as charging means. A latent image is formed on the photosensitive drum 61 by illuminating illumination light from the exposure control portion 60 onto the surface of the photosensitive drum. Further, the latent image on the photosensitive drum 61 is developed with toner by developing devices 62, 63 as developing means.

Incidentally, in the illustrated embodiment, before the latent image is formed on the photosensitive drum 61 by the exposure control portion 60, a part of the photosensitive drum 61 is exposed by a blank exposing device 79 as exposing means disposed between the primary charger 78 and the developing devices 62, 63.

The toner image on the photosensitive drum 61 developed in this way is transferred, at a transferring portion, onto a sheet S conveyed by a sheet feeding roller 21 from a sheet feeding cassette 1 as sheet containing means of a sheet feeding apparatus 40 in synchronous with formation of the latent image. Thereafter, the transferred toner image is fixed onto the sheet S in a fixing portion 67. Then, the sheet is discharged out of the image forming apparatus by a sheet discharging portion 68. Incidentally, for example, when an image is formed on a back surface of the sheet, the sheet is introduced into reverse passages 72, 73, 74 by switching a flapper 70, thereby reversing a front surface and a rear surface of the sheet. Thereafter, the sheet is conveyed again toward the photosensitive drum 61.

Figure 2:
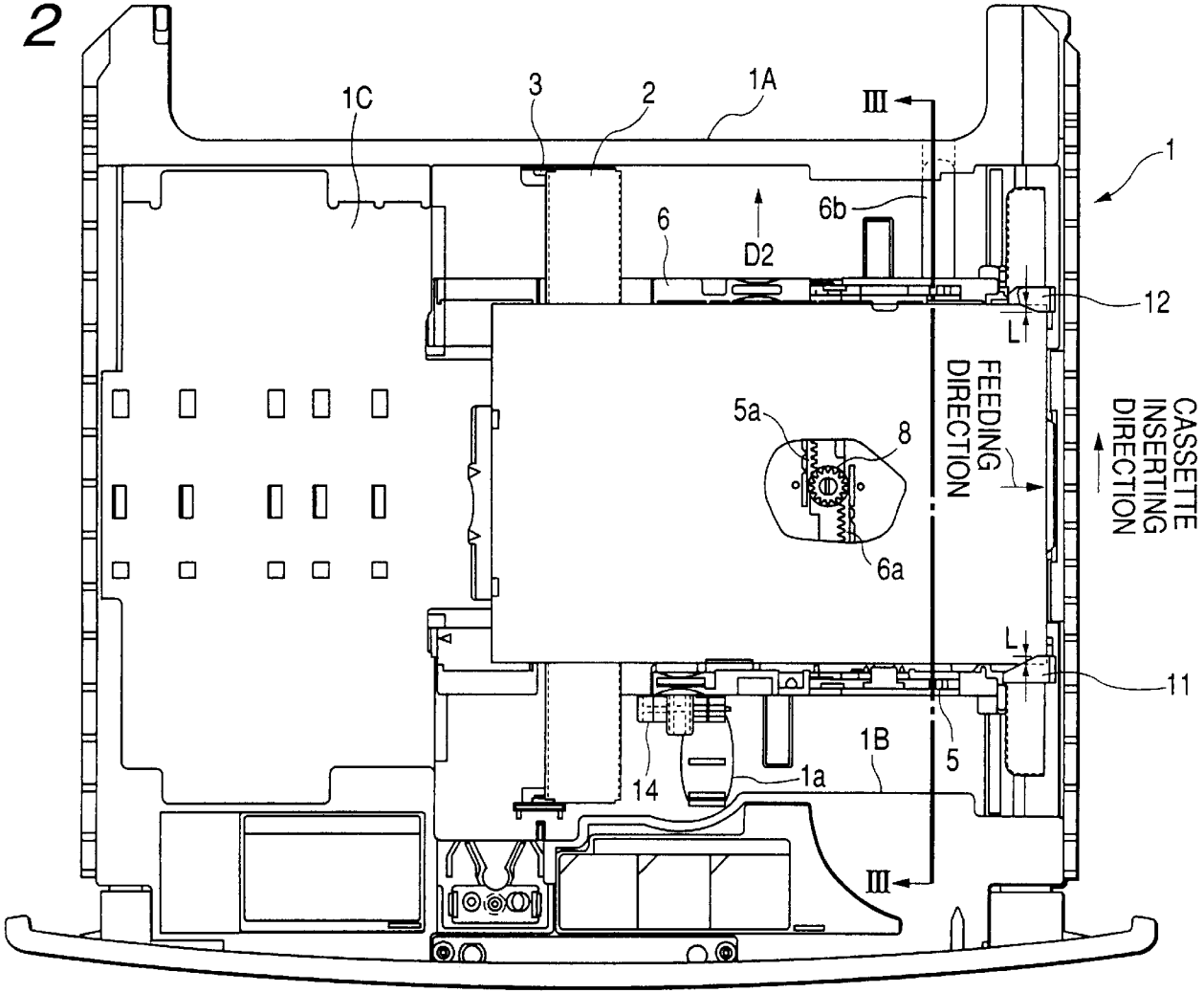
FIG. 2 is a top plan view of a sheet feeding cassette of the sheet feeding apparatus.
Figure 3:
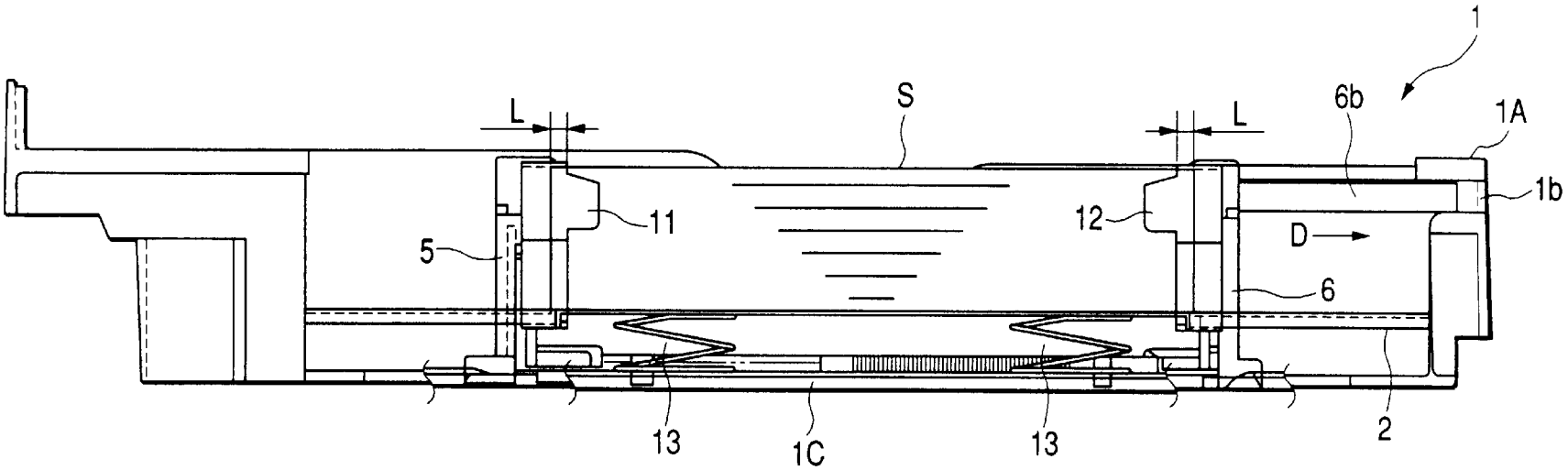
FIG. 3 is a sectional view taken along the line III—III in FIG. 2.
Figure 11:
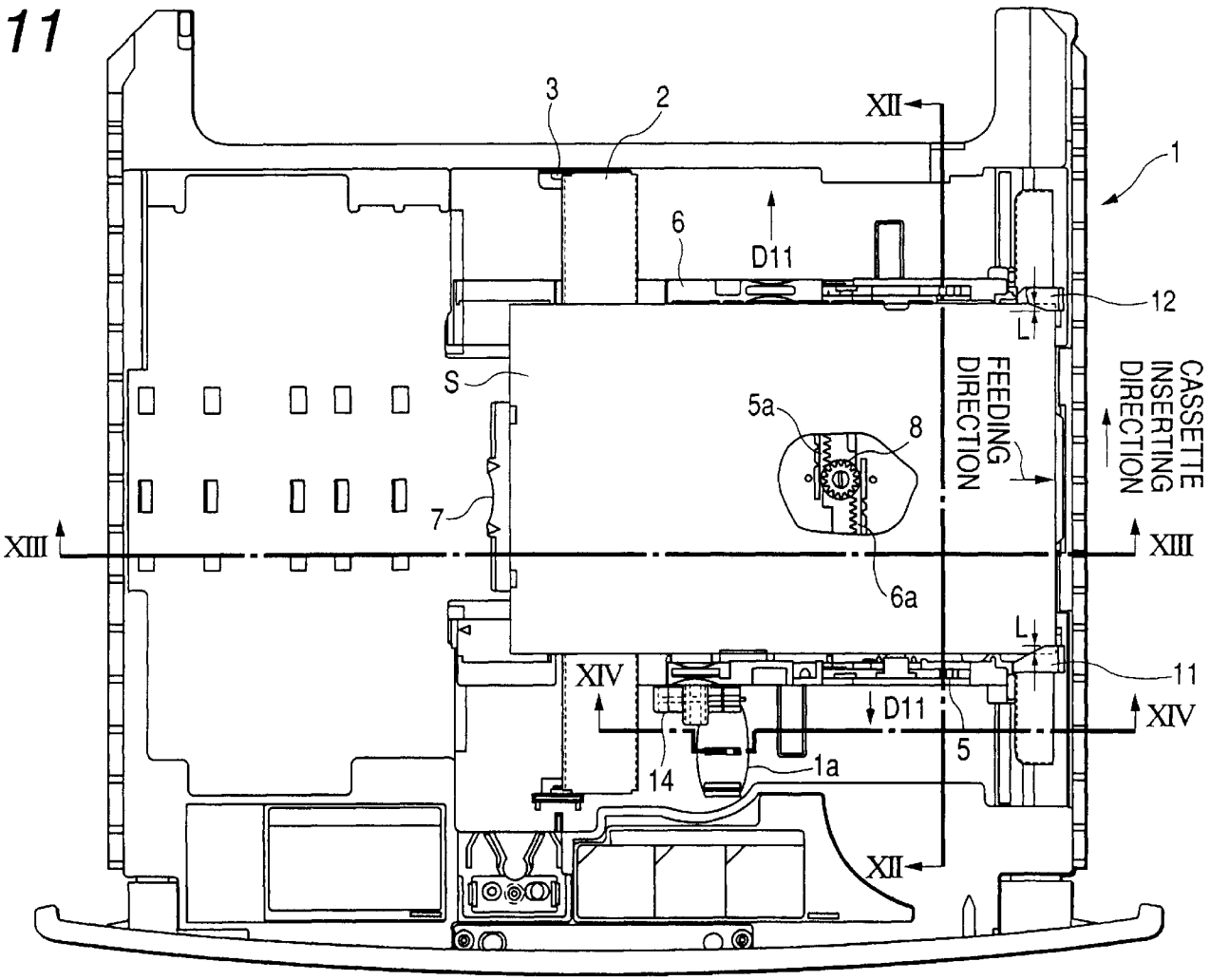
FIG. 11 is a top plan view of a conventional universal cassette.
Figure 12:
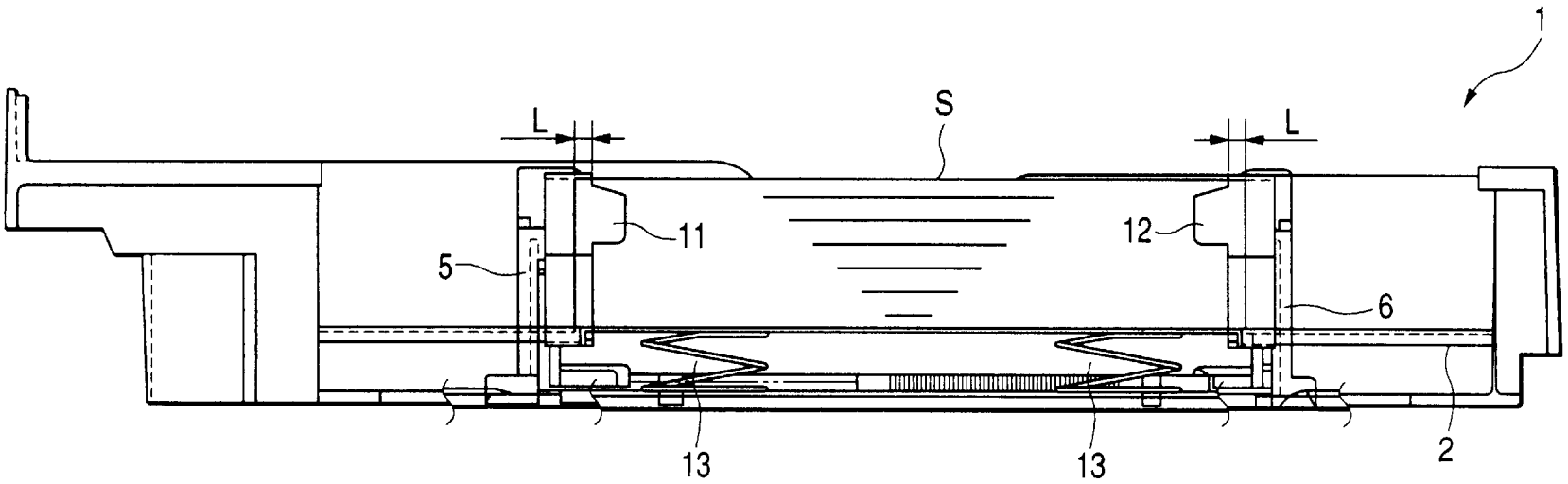
FIG. 12 is a sectional view taken along the line XII—XII in FIG. 11.
Figure 13:
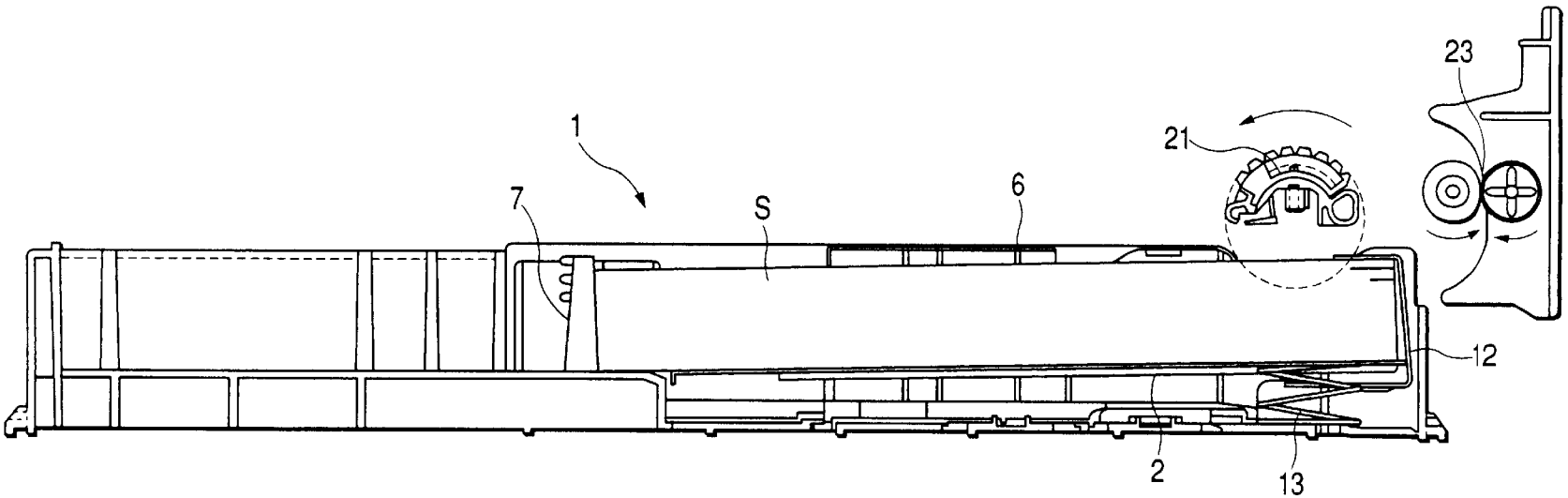
FIG. 13 is a sectional view taken along the line XIII—XIII in FIG. 11.
Figure 14:
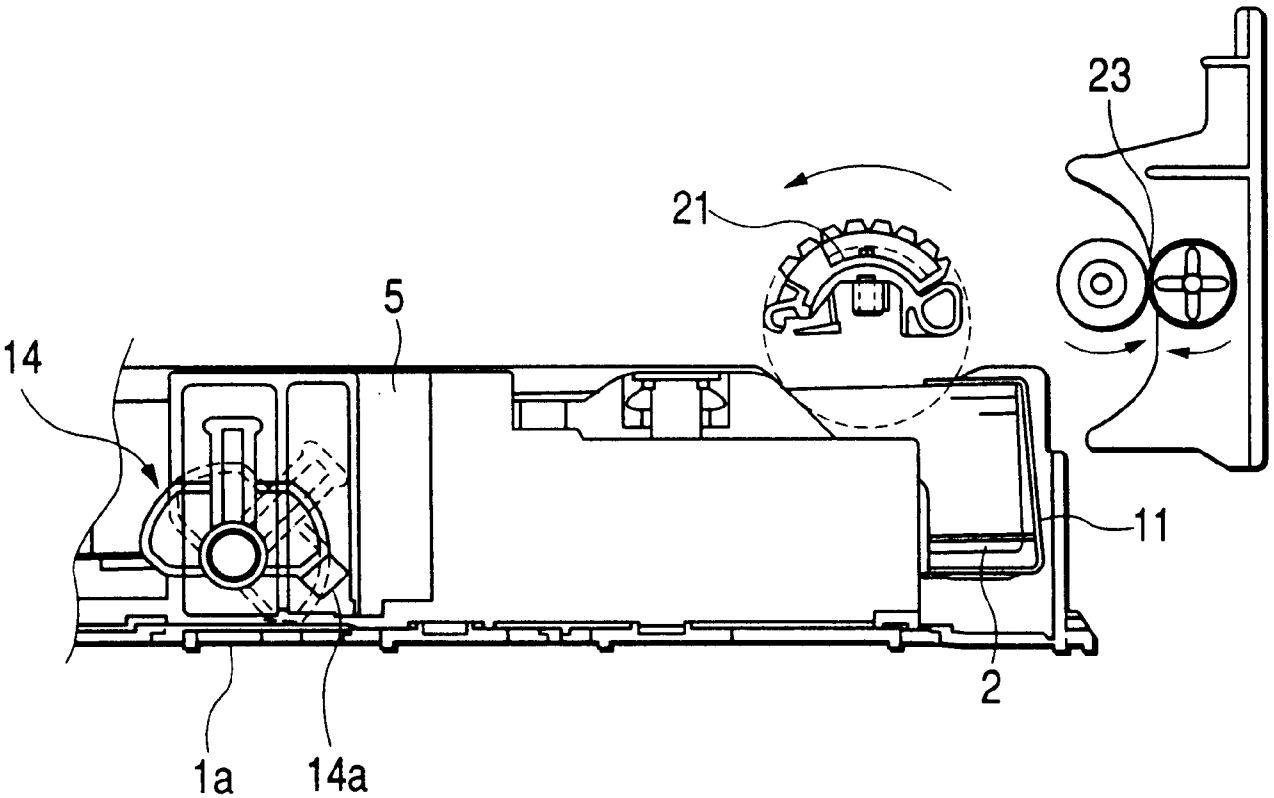
FIG. 14 is a sectional view taken along the line XIV—XIV in FIG. 11.
Figure 15:
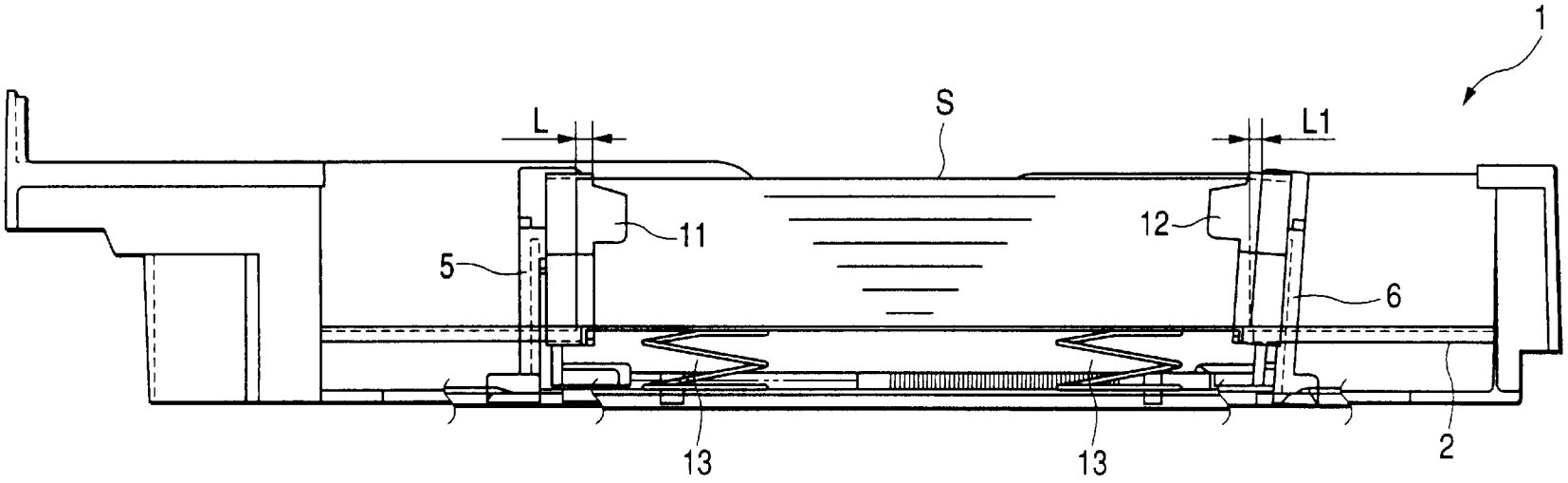
FIG. 15 is a view for explaining inconvenience of the conventional universal cassette.

FIG. 2 is a top plan view of a sheet feeding cassette, and FIG. 3 is a sectional view taken along the line III—III in FIG. 2. Incidentally, in FIGS. 2 and 3, the same or equivalent elements as those in FIGS. 11 and 15 are designated by the same reference numerals.

In FIGS. 2 and 3, similar to the conventional sheet feeding cassette, the sheet feeding cassette includes an intermediate plate 2 rotatable around a shaft 3 secured to the sheet feeding cassette 1, an intermediate plate spring 13 for lifting the intermediate plate 2, sheets S, and a trailing end regulating plate 7 for regulating trailing ends of the sheets.

Further, the sheet feeding cassette 1 is provided with a pair of side regulating plates 5, 6 movable in a width-wise direction of the sheet S and adapted to regulate left and right lateral edges of the sheets S, and the side regulating plates 5, 6 has racks 5*a*, 6*a*, respectively, and a pinion gear 8 is engaged by central portions of the racks 5*a*, 6*a*.

By the provision of such a rack mechanism, the front side or first side regulating plate 5 and the rear side or second side regulating plate 6 in a mounting direction of the sheet feeding cassette 1 can be slid in a direction shown by the arrow $D_2$ in synchronous with each other so that both lateral edges of the sheets S can be regulated simultaneously with respect the center as a conveyance reference of sheet. Incidentally, FIGS. 2 and 3 show a condition that sheets S having minimum size are contained in the sheet feeding cassette 1.

In FIGS. 2 and 3, the sheet feeding cassette 1 has a frame including a bottom plate 1C and side walls upright from the bottom plate 1C. Here, the side plates of the sheet feeding cassette 1 are constituted by a front side plate (referred to as "first side plate" hereinafter) 1B and a rear side plate (referred to as "second side plate" hereinafter) 1A.

Now, flexion preventing means for preventing flexion of the side regulating plates which is one of characteristics of the present invention will be explained. A rib member 6*b* as a protruded portion protruding toward the second side plate 1A along the mounting direction of the sheet feeding cassette 1 is provided at an upper end of the rear side or second side regulating plate 6 in the mounting direction of the sheet feeding cassette 1. Further, the second side plate 1A is provided with an insertion opening 1*b* at a position corresponding to the rib member 6*b*, and the insertion opening 1*b* is formed with a size so that the rib member 6*b* of the second side regulating plate 6 fits into the insertion opening.

Incidentally, FIGS. 2 and 3 show the condition that sheets S having minimum size are contained in the sheet feeding cassette 1. In this case, a tip end of the rib member 6*b* of the second side regulating plate 6 is inserted into the insertion opening 1*b*. However, when sheets having maximum size are contained, the tip end of the rib member 6*b* is protruded from the insertion opening 1*b* as the second side regulating plate 6 is shifted in the direction D. Accordingly, the rib member 6*b* is always fitted into the insertion opening 1*b* in the condition that the containable sheets from minimum sheets to maximum sheets are contained.

By inserting the rib member 6*b* of the sheet side regulating plate 6 in the insertion opening 1*b* in this way, the second side regulating plate 6 is shiftably supported by the second side plate 1A via the rib member 6*b*. Further, even if an up-and-down direction force is applied to the rib member 6*b* via the second side regulating plate 6, since the rib member 6*b* is supported by the insertion opening 1*b* and accordingly the second side plate 1A, the movement of the rib member in the up-and-down direction is regulated.

Thus, when the sheet feeding cassette 1 is mounted with a strong force, if the sheets S strike against the second side regulating plate 6 due to inertia to generate a force tending to flex the second side regulating plate 6 outwardly, since the rib member 6*b* is not shifted in the up-and-down direction, the second side regulating plate 6 is not almost flexed.

Accordingly, when the sheet feeding cassette 1 is mounted, a flexed amount of the second side regulating plate 6 becomes smaller than a width L of the sheet caught by the front side separation claw 11, thereby preventing the sheet S from disengaging from the separation claws 11, 12.

In this way, by supporting the second side regulating plate 6 by the second side plate 1A via the rib member 6*b*, the sheets S can be prevented from being disengaged from the separation claws 11, 12 due to shock during the mounting of the sheet feeding cassette. Thus, thereafter, even when the sheet feeding cassette 1 is mounted and dismounted with respect to the main body of the image forming apparatus 50, the sheet is not pinched between the cassette and the main body of the image forming apparatus 50, thereby preventing the damage of the sheet. Further, the sheet is not waiting in a skew condition, and, thus, in the next sheet feeding operation, skew feeding and sheet jam do not occur.

Incidentally, in the above-mentioned description, while an example that the rib member 6*b* is provided on the second side regulating plate 6 was explained, of course, rib members may be provided on both first and second side regulating plates 5, 6 and these rib members may be supported by insertion openings provided in the first and second side plates 1A, 1B.

Next, a second embodiment of the present invention will be explained.

Figure 4:
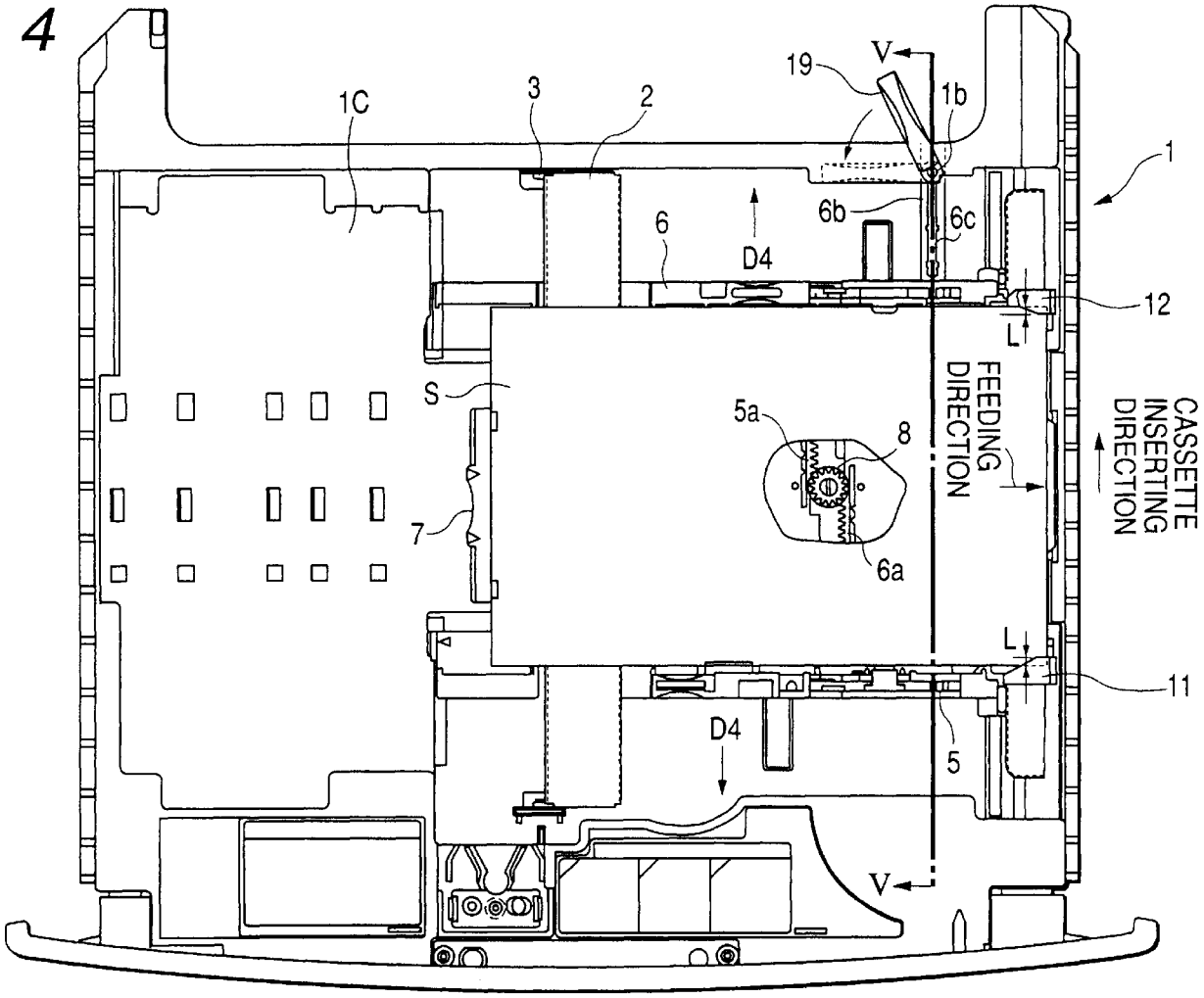
FIG. 4 is a top plan view of a sheet feeding cassette of a sheet feeding apparatus according to a second embodiment of the present invention.
Figure 5:
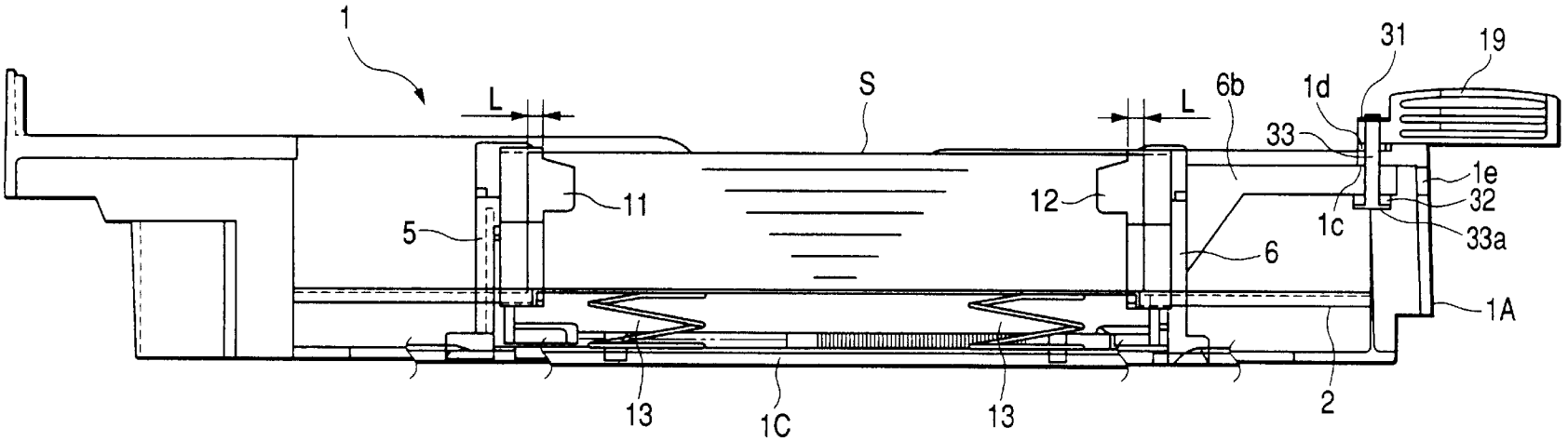
FIG. 5 is a sectional view taken along the line V—V in FIG. 4.

FIG. 4 is a top plan view of a sheet feeding cassette of a sheet feeding apparatus according to a second embodiment of the present invention, and FIG. 5 is a sectional view taken along the line V—V in FIG. 4. Incidentally, in FIGS. 4 and 5, the same reference numerals as those in FIGS. 2 and 3 designate the same or equivalent elements, and FIGS. 4 and 5 show the condition that sheets S having minimum size are contained n the sheet feeding cassette 1. Incidentally, the same elements as those in the first embodiment are designated by the same reference numerals and detailed explanation thereof will be omitted.

Now, flexion preventing means for preventing flexion of the side regulating plates according to the second embodiment will be explained.

In FIGS. 4 and 5, a slit 6*c* is formed in the rib member 6*b* of the second side regulating plate 6 to extend along the rib member 6*b*, and a through hole 1*c* is formed in an upper end portion of the second side plate 1A. A shaft 33 is passed through the slit 6*c* and the through hole 1*c*.

The shaft 33 is provided at its bottom with a seat surface 33*a*. The shaft 33 is passed through an elastic member 32, slit 6c, through hole 1*c* and a fixing member 19 successively from below, and an upper end of the shaft is locked by a washer 31.

The fixing member 19 is rotatably attached to the shaft 33 to shift the shaft 33 upwardly by rotation of the fixing member, thereby pinching and fixing the rib member 6*b* between the second side plate 1A and the seat surface 33*a*. Incidentally, an arrangement for shifting the shaft 33 upwardly will be fully described later.

Figure 6:
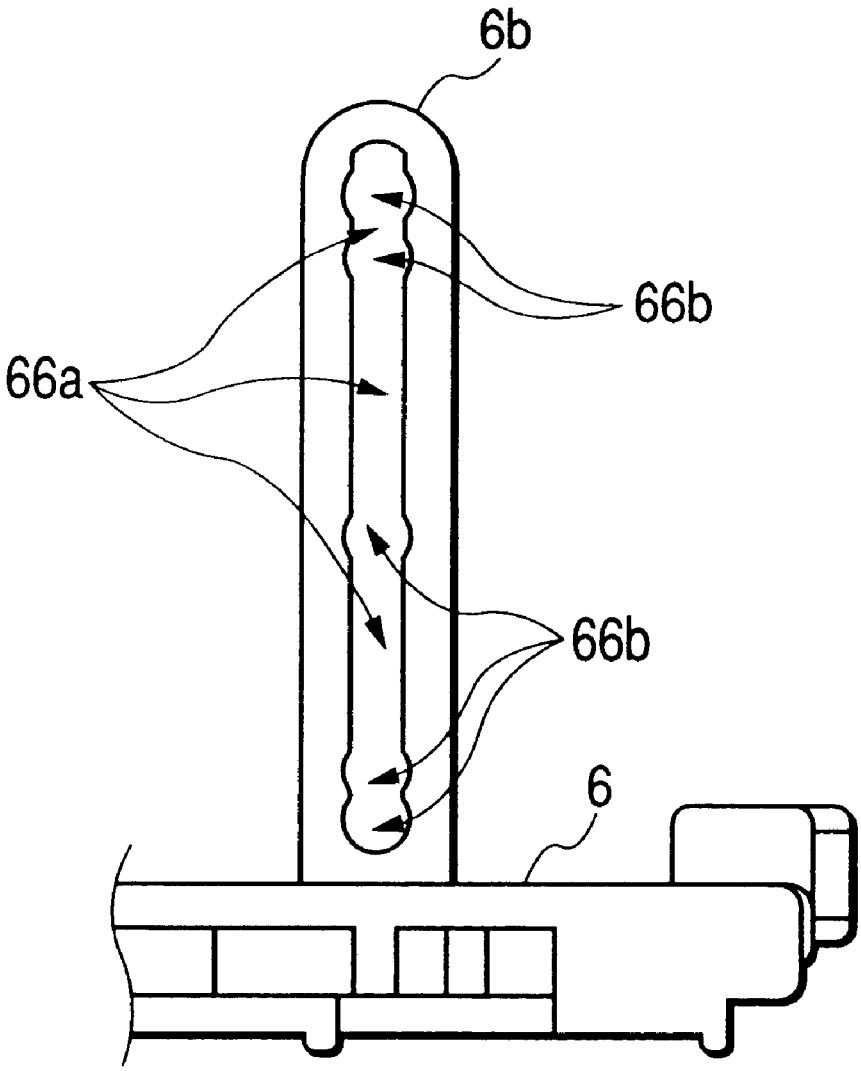
FIG. 6 is a top plan view for explaining a construction of a rib member provided on a second side regulating plate of the sheet feeding cassette.

As shown in FIG. 6, the slit 6*c* of the rib member 6*c* has a slit portion 66*a* having a dimension slightly smaller than a diameter of the shaft 33, and a plurality of fixing holes 66*b* as fixing portions having diameters same as that of the shaft 33. The number of the fixing holes 66*b* correspond to the number of sizes of various sheets to be contained in the sheet feeding cassette 1.

An opening portion 1*e* is formed in the side of the second side plate 1A in such a manner that, when the sheets having the maximum size are contained, as the second side regulating plate 6 is shifted in the direction D , the tip end of the rib member 6*b* is protruded from the opening portion 1*e*.

When the first side regulating plate 5 and the second side regulating plate 6 are slid in a direction shown by the arrow D4 in synchronous with each other by the above-mentioned rack mechanism including the racks 5*a*, 6*a*and the pinion gear 8 to reach a position where the both lateral edges of the sheets are simultaneously regulated with respect to the center as reference, the shaft 33 is fitted into the fixing hole 66*b* of the rib member 6*b* shifted together with the second side regulating plate 6 while elastically widening the slit portion 66*a*by the shaft 33. As a result, the first and second side regulating plates 5, 6 are positioned.

Figure 7:
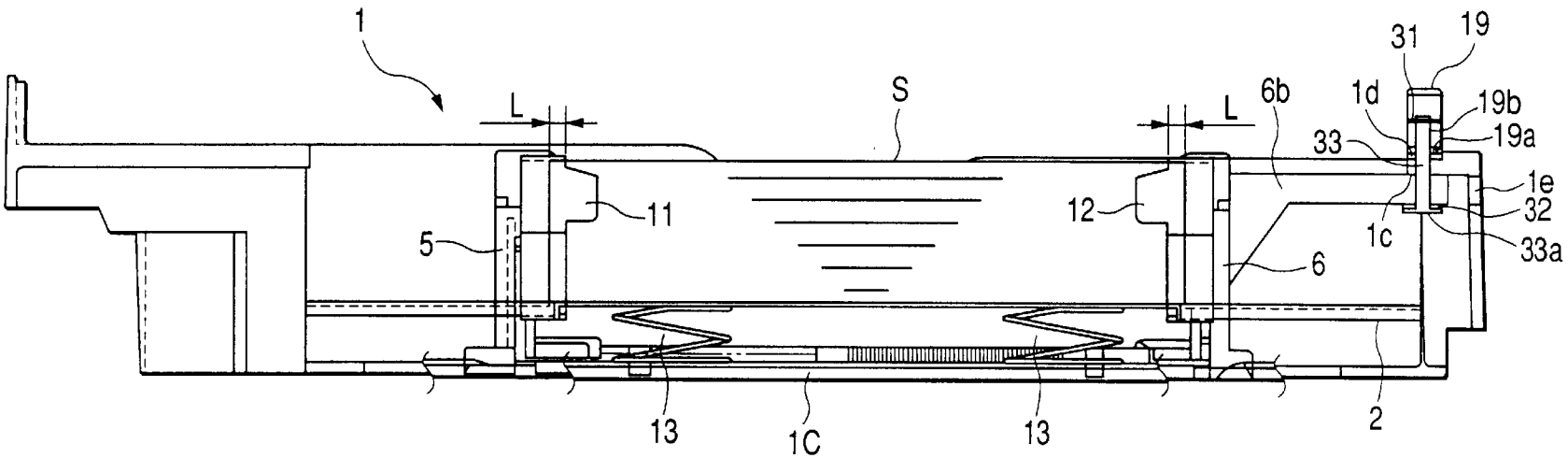
FIG. 7 is a view showing a fixing condition of a fixing member provided on the sheet feeding cassette.

As shown in FIG. 7, convex/concave portions 1*d*, 19*a* are formed on an edge of the through hole 1*c* and an edge of a shaft attaching hole 19*b* of the fixing member 19. As shown in FIG. 4, when the fixing member 19 is positioned at a non-fixing position shown by the solid line, the convex/concave portion 1*d* formed around the through hole 1*c* of the second side plate 1A is engaged by the convex/concave portion 19*a* formed around the shaft attaching hole 19*b* of the fixing member 19.

When the convex/concave portion 19*a* of the fixing member 19 is engaged by the convex/concave portion 1*d* of the second side plate 1A in this way, since the fixing member 19 does not affect an influence upon the side regulating plate 6, the second side regulating plate 6 can be shifted.

On the other hand, when the fixing member 19 is rotated in a direction shown by the arrow H to reach a fixing position, convex parts of the convex/concave portion 19*a* of the fixing member 19 are aligned with convex parts of the convex/concave portion 1*d* of the second side plate 1A, with the result that the shaft 33 is lifted by the fixing member 19.

When the shaft 33 is lifted in this way, the shaft 33 cooperates with the second side plate 1A to pinch the rib member 6*b* of the second side regulating plate 6 therebetween while compressing the elastic member 32, with the result that the second side regulating plate 6 is fixed and cannot be shifted.

By fixing the second side regulating plate 6 in this way, when the sheet feeding cassette 1 is mounted with the strong force, if the sheet stack strikes against the second side regulating plate 6 due to inertia, since the second side regulating plate 6 is fixed to the second side plate 1A via the rib member 6*b*, it is not almost flexed.

Accordingly, when the sheet feeding cassette 1 is inserted, the flexed amount of the second side regulating plate 6 becomes smaller than the width L of the sheet caught by the front side separation claw 11, thereby preventing the sheets S from being disengaged from the separation claws 11, 12.

By fixing the second side regulating plate 6 to the second side plate 1A by the fixing member 19 in this way, the sheets S can be prevented from being disengaged from the separation claws 11, 12 due to the shock during the mounting of the sheet feeding cassette. Thus, thereafter, even when the sheet feeding cassette 1 is mounted and dismounted with respect to the main body of the image forming apparatus 50, the sheet is not pinched between the cassette and the main body of the image forming apparatus 50, thereby preventing the damage of the sheet. Further, the sheet is not waiting in a skew condition, and, thus, in the next sheet feeding operation, skew feeding and sheet jam do not occur.

Figure 8:
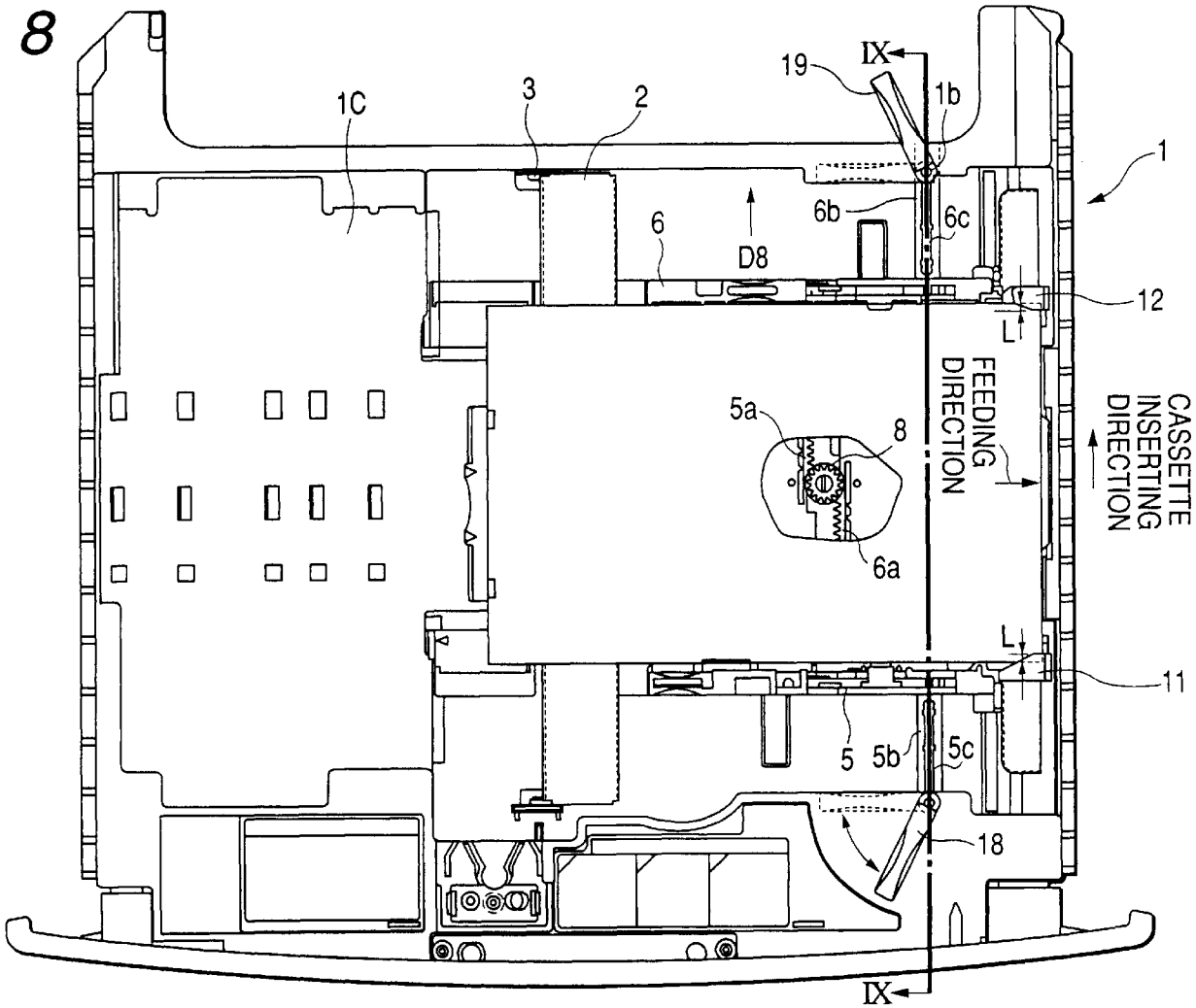
FIG. 8 is a top plan view of a sheet feeding cassette of a sheet feeding apparatus according to a third embodiment of the present invention.
Figure 9:
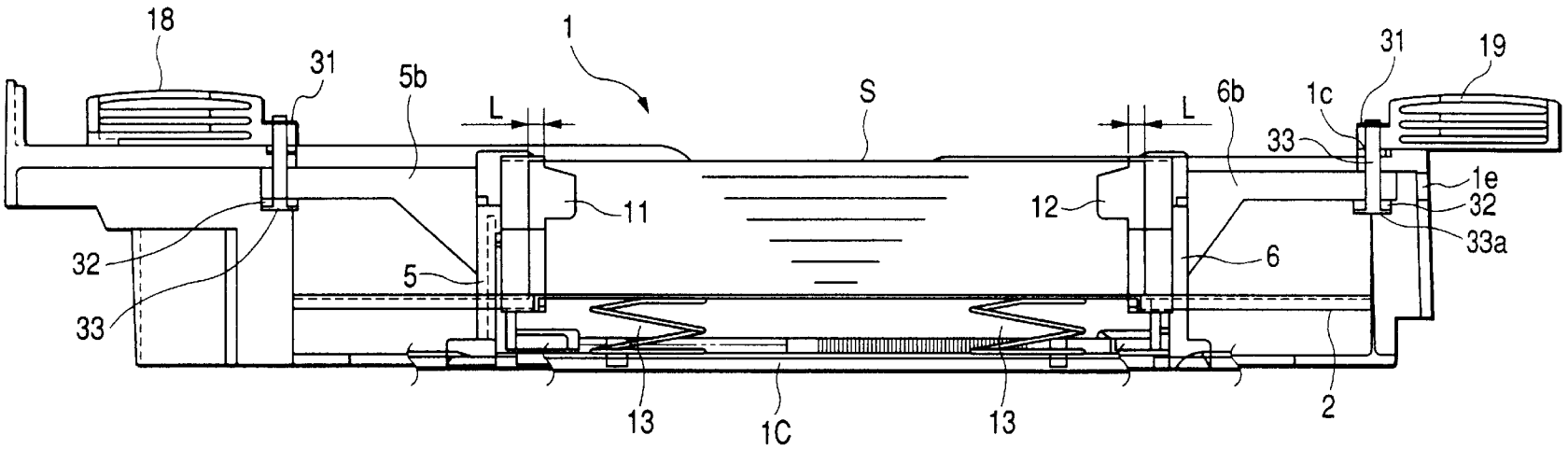
FIG. 9 is a sectional view taken along the line IX—IX in FIG. 8.

In the above-mentioned description, while an example that the second side regulating plate 6 is fixed to the second side plate 1A was explained, as a third embodiment of the present invention, as shown in FIGS. 8 and 9, the first and second side regulating plates 5, 6 may have rib members 5*b*, 6*b* having slits 5*c*, 6*c*, and fixing members 18, 19 for fixing the rib members 5*b*, 6*b* to the first and second side plates 1A, 1B.

Figure 10:
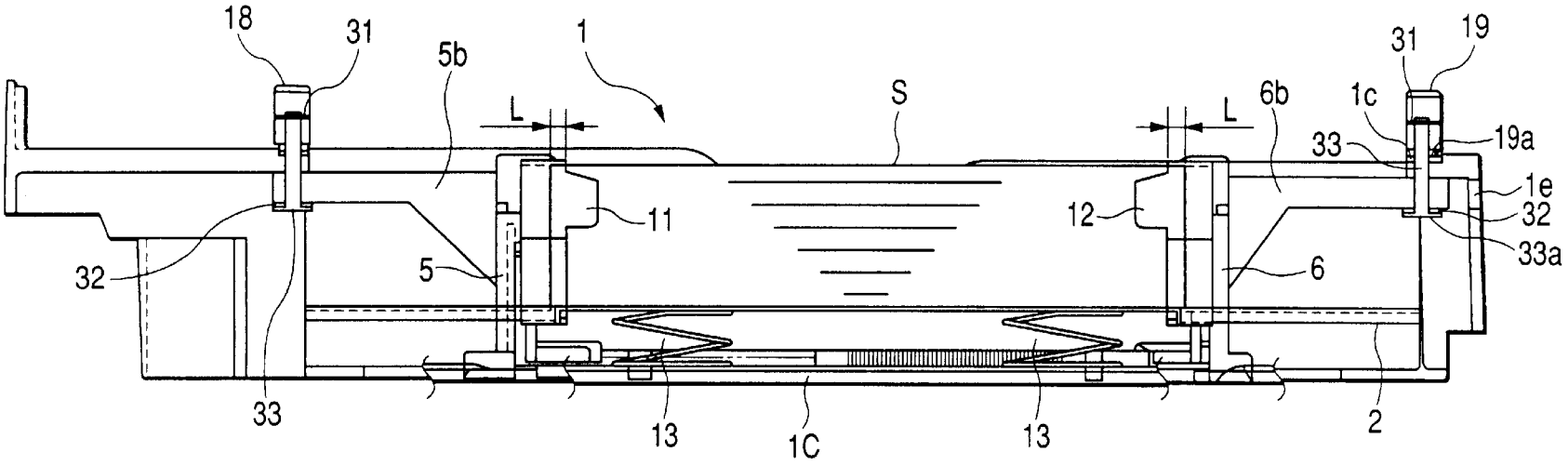
FIG. 10 is a view showing a fixing condition of a fixing member provided on the sheet feeding cassette.

As shown in FIG. 10, by fixing the first and second side regulating plates 5, 6 to the first and second side plates 1A, 1B by means of the fixing members 18, 19, the sheets S can surely be prevented from being disengaged from the separation claws 11, 12 due to the shock during the mounting of the sheet feeding cassette. Further, the sheets S can be prevented from being disengaged from the separation claws 11, 12 due to the shock during the dismounting of the sheet feeding cassette 1.

As mentioned above, according to the present invention, by providing the protruded portion on the side regulating member and by supporting or fixing the protruded portion by means of the side plate of the sheet containing means, when the sheet containing means are mounted, the sheets are prevented from striking against the side regulating plate to incline the latter, thereby preventing the sheets from disengaging from the separation claws.

Thus, even when the sheet feeding cassette is mounted and dismounted with respect to the main body of the image forming apparatus, the sheet is not pinched between the cassette and the main body of the image forming apparatus, thereby preventing the damage of the sheet. Further, the sheet is not waiting in a skew condition, and, thus, in the next sheet feeding operation, skew feeding and sheet jam do not occur.

What is claimed is:

1. A sheet containing apparatus mounted to an image forming apparatus and adapted to contain a sheet to be supplied to image forming means of said image forming apparatus, comprising:

a frame having a bottom plate and a side plate upright from said bottom plate;

end regulating means movable in accordance with a size of a sheet contained in said frame and adapted to regulate an end of the sheet; and flexion preventing means provided on said end regulating means and adapted to prevent said end regulating means from being flexed by engagement with said side plate.

2. A sheet containing apparatus according to claim 1, wherein said flexion preventing means include a protruded portion provided on said end regulating means to extend toward said side plate along a shifting direction of said end regulating means, and an insertion opening formed in said side plate at a position opposing to said protruded portion and have a size so that said protruded portion fits slidably into said insertion opening, and, said flexion preventing means supports said end regulating means so as not to flex by inserting said protruded portion into said insertion opening regardless of a position of said end regulating means.

3. A sheet containing apparatus according to claim 1, wherein said flexion preventing means include a protruded portion provided on said end regulating means to extend toward said side plate along a shifting direction of said end regulating means, and fixing means provided on said side plate and capable of fixing said protruded portion to said side plate regardless of a position of said end regulating means.

4. A sheet containing apparatus according to claim 3, wherein said fixing means include a slit formed in said protruded portion to extend in a direction parallel to a direction along which said protruded portion extends, a shaft provided on said side plate and adapted to be inserted into said slit, and pinching means for pinching said protruded portion via said shaft.

5. A sheet containing apparatus according to claim 4, wherein said slit formed in said protruded portion has a dimension slightly smaller than a diameter of said shaft, and a plurality of fixing holes each having a diameter substantially the same as a diameter of said shaft are formed on the way of said slit, so that, when said shaft is in the fixing hole, by fixing said protruded portion to said side plate by means of said pinching means, said end regulating means is positioned at a position where an end of a sheet having a fixed form is regulated.

6. A sheet containing apparatus according to claim 1, wherein a separation claw for separating the sheets to be fed out one by one is attached to said end regulating means in correspondence to a corner of a tip end of the sheet contained, and said protruded portion is disposed in the vicinity of said separation claw.

7. A sheet containing apparatus according to claim 6, wherein a mounting direction of said sheet containing apparatus to said image forming apparatus is the same as a direction along which said protruded portion provided extendedly.

8. A sheet feeding apparatus provided in an image forming apparatus and adapted to supply a sheet to image forming means of said image forming apparatus, comprising:

a main body of said image forming apparatus;

a sheet containing apparatus detachably attached to said main body of said image forming apparatus and adapted to contain a sheet to be supplied to said image forming means;

sheet feeding means for feeding out the sheet in a direction perpendicular to a mounting direction of said sheet containing apparatus to said main body of said image forming apparatus; and separating means for separating the sheets to be fed out by said sheet feeding means one by one;

and wherein said sheet containing apparatus including:

a frame having a bottom plate and a side plate upright from said bottom plate;

side regulating members movable in accordance with a size of the sheet contained in said frame and adapted to regulate left and right lateral edges of the sheet with respect to a sheet feeding direction; and flexion preventing means provided on at least one of said left and right side regulating members and adapted to prevent said side regulating member from being flexed by engaging with said side plate.

9. A sheet feeding apparatus according to claim 8, wherein said flexion preventing means include a protruded portion provided on said side regulating member to extend toward said side plate along a shifting direction of said side regulating member, and an insertion opening formed in said side plate at a position opposing to said protruded portion and have a size so that said protruded portion fits slidably into said insertion opening, and said flexion preventing means supports said side regulating member so as not to flex by inserting said protruded portion into said insertion opening regardless of a position of said side regulating member.

10. A sheet feeding apparatus according to claim 9, wherein an attaching/detaching direction of said sheet containing apparatus to said main body of said image forming apparatus, the shifting direction of said side regulating member, and a direction along which said protruded portion extends are parallel with each other.

11. A sheet feeding apparatus according to claim 8, wherein said flexion preventing means include a protruded portion provided on said side regulating member to extend toward said side plate along a shifting direction of said side regulating member, and fixing means capable of fixing said protruded portion to said side plate regardless of a position of said side regulating member.

12. A sheet feeding apparatus according to claim 11, wherein said fixing means include a slit formed in said protruded portion to extend in a direction parallel to a direction along which said protruded portion extends, and fixing means provided on said side plate and adapted to be inserted into said slit to shiftably support said side regulating member and capable of fixing said protruded portion to said side plate at a predetermined position.

13. A sheet feeding apparatus according to claim 12, wherein said fixing means include a slit formed in said protruded portion to extend in a direction parallel to a direction along which said protruded portion extends, a shaft provided on said side plate and adapted to be inserted into said slit, and pinching means for pinching said protruded portion via said shaft.

14. A sheet feeding apparatus according to claim 13, wherein said slit formed in said protruded portion has a dimension slightly smaller than a diameter of said shaft, and a plurality of fixing holes each having a diameter substantially the same as a diameter of said shaft are formed on the way of said slit, so that, when said shaft is in the fixing hole, by fixing said protruded portion to said side plate by means of said pinching means, said side regulating member is positioned at a position where an end of a sheet having a fixed form is regulated.

15. A sheet feeding apparatus according to claim 11, wherein an attaching/detaching direction of said sheet containing apparatus to said main body of said image forming apparatus, the shifting direction of said side regulating member, and a direction along which said protruded portion extends are parallel with each other.

16. A sheet feeding apparatus according to claim 8, wherein a separation claw for separating the sheets fed out by said sheet feeding means one by one is provided on said side regulating member in correspondence to a corner of a tip end of the sheet, and said protruded portion is disposed in the vicinity of said separation claw.

17. A sheet feeding apparatus according to claim 8, wherein said sheet containing apparatus is detachably provided in said main body of said image forming apparatus from an operating side of said image forming apparatus.

18. A sheet feeding apparatus according to claim 8, wherein said left and right side regulating members are connected to each other via a synchronous mechanism in such a manner that one of said side regulating members is shifted in synchronous with a movement of the other side regulating member.

19. An image forming apparatus having a sheet feeding apparatus for supplying a sheet to image forming means, comprising:

main body of said image forming apparatus, a sheet containing apparatus detachably attached to said main body of said image forming apparatus and adapted to contain a sheet to be supplied to said image forming means;

sheet feeding means for feeding out the sheet in a direction perpendicular to a mounting direction of said sheet containing apparatus to said main body of said image forming apparatus; and separation means for separating the sheets to be fed out by said sheet feeding means one by one;

wherein said sheet containing apparatus including:

a frame having a bottom plate and a side plate upright from said bottom plate;

side regulating members movable in accordance with a size of the sheet contained in said frame and adapted to regulate left and right lateral edges of the sheet with respect to a sheet feeding direction; and flexion preventing means provided on at least one of said side regulating members and adapted to prevent said side regulating member from being flexed by engagement with said side plate.

* * * * *

UNITED STATES PATENT AND TRADEMARK OFFICE

CERTIFICATE OF CORRECTION

PATENT NO. : 6,332,610 B1
DATED : December 25, 2001
INVENTOR(S) : Hiroshi Hiura

It is certified that error appears in the above-identified patent and that said Letters Patent is hereby corrected as shown below:

Column 1,
Line 16, "cassette," should read -- cassettes, --.
Line 62, "synchronous" should read -- synchronism --.
Line 64, "respect" should read -- respect to --.
Line 65, "of" should read -- of a --.

Column 2,
Line 8, "la" should read -- 1a --.

Column 4,
Line 48, "synchronous" should read -- synchronism --.

Column 5,
Line 12, "synchronous" should read -- synchronism --.
Line 14, "respect" should read -- respect to --; and "of" should read -- of a --.

Column 6,
Line 29, "n" should read -- in --.

Column 7,
Line 1, "synchronous" should read -- synchronism --.
Line 2, "6aand" should read -- 6a and --.
Line 3, "the both" should read -- both --.
Line 8, "66aby" should read -- 66a by --.

Column 8,
Line 41, "include" should read -- includes --.
Line 52, "include" should read -- includes --.
Line 59, "include" should read -- includes --.

UNITED STATES PATENT AND TRADEMARK OFFICE

CERTIFICATE OF CORRECTION

PATENT NO. : 6,332,610 B1
DATED : December 25, 2001
INVENTOR(S) : Hiroshi Hiura

It is certified that error appears in the above-identified patent and that said Letters Patent is hereby corrected as shown below:

Column 9,
Line 43, "include" should read -- includes --.
Line 59, "include" should read -- includes --.
Line 66, "include" should read -- includes --.

Column 10,
Line 6, "include" should read -- includes --.
Line 39, "synchronous" should read -- synchronism --.
Line 44, "apparatus," should read -- apparatus; --.

Signed and Sealed this

Seventh Day of May, 2002

*Attest:*

*Attesting Officer*

JAMES E. ROGAN
*Director of the United States Patent and Trademark Office*